US008948617B2

(12) United States Patent
Shiraki et al.

(10) Patent No.: US 8,948,617 B2
(45) Date of Patent: Feb. 3, 2015

(54) CARTRIDGE PROVIDED WITH PIVOTABLE MEMBER FOR NEW PRODUCT DETECTION

(71) Applicants: Masatoshi Shiraki, Nagoya (JP); Yasuo Fukamachi, Nagoya (JP)

(72) Inventors: Masatoshi Shiraki, Nagoya (JP); Yasuo Fukamachi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 138 days.

(21) Appl. No.: 13/628,492

(22) Filed: Sep. 27, 2012

(65) Prior Publication Data

US 2013/0136460 A1 May 30, 2013

(30) Foreign Application Priority Data

Nov. 24, 2011 (JP) ..... 2011-256106

(51) Int. Cl.
*G03G 15/08* (2006.01)
*G03G 15/00* (2006.01)

(52) U.S. Cl.
CPC ..... *G03G 15/0832* (2013.01); *G03G 15/553* (2013.01); *G03G 2215/0697* (2013.01)
USPC ..... 399/12

(58) Field of Classification Search
CPC ..... G03G 15/08
USPC ..... 399/12
See application file for complete search history.

(56) References Cited

U.S. PATENT DOCUMENTS

| | | | | |
|---|---|---|---|---|
| 7,463,834 | B2 | 12/2008 | Takagi et al. | |
| 7,512,347 | B2 * | 3/2009 | Suzuki et al. | 399/12 |
| 2006/0193643 | A1 | 8/2006 | Takagi et al. | |
| 2006/0193646 | A1 * | 8/2006 | Suzuki et al. | 399/12 |
| 2011/0243578 | A1 | 10/2011 | Ukai et al. | |
| 2012/0051795 | A1 * | 3/2012 | Mushika et al. | 399/262 |
| 2012/0251216 | A1 * | 10/2012 | Mushika | 400/352 |
| 2012/0321345 | A1 | 12/2012 | Shinoya et al. | |
| 2013/0136460 | A1 * | 5/2013 | Shiraki et al. | 399/12 |
| 2013/0170845 | A1 * | 7/2013 | Itabashi | 399/12 |

FOREIGN PATENT DOCUMENTS

| | | | |
|---|---|---|---|
| JP | 2006-243072 | A | 9/2006 |
| JP | 2006-267994 | A | 10/2006 |
| JP | 2011-215374 | A | 10/2011 |
| JP | 2012-212086 | | 11/2012 |
| JP | 2012-233941 | | 11/2012 |

* cited by examiner

*Primary Examiner* — Clayton E Laballe
*Assistant Examiner* — Kevin Butler
(74) *Attorney, Agent, or Firm* — Banner & Witcoff, Ltd.

(57) ABSTRACT

A cartridge includes: a casing for accommodating developer; a rotatable body rotatably provided at the casing; a pivot member; and a biasing member. The rotatable body is rotatable about a rotational axis, the rotatable body having an outer circumference defining a rotational path during rotation. The pivot member is disposed at the rotatable body at a position offset from the rotational axis and is pivotable about a pivot fulcrum extending in a direction parallel to a tangential direction of the rotational path. The pivot member being pivotably movable between an erect position in which the pivot member erects to form a first angle relative to the rotatable body and a collapsed position in which the pivot member pivots toward the rotatable body to form a second angle smaller than the first angle relative to the rotational body. The biasing member biases the pivot member toward the erect position.

7 Claims, 12 Drawing Sheets

TOP
BOTTOM
LEFT
RIGHT
A–A
B–B
50
55
56
57
58
60
61
62
63
64
65
66
67
68
69
70
71
72
73
75
76
107
108
110
69(62)
67(61)
Θ1
Θ2
L
P

CARTRIDGE PROVIDED WITH PIVOTABLE MEMBER FOR NEW PRODUCT DETECTION

CROSS REFERENCE TO RELATED APPLICATION

This application claims priority from Japanese Patent Application No. 2011-256106 filed Nov. 24, 2011. The entire content of the priority application is incorporated herein by reference.

TECHNICAL FIELD

The present invention relates to a cartridge that is mountable in an electrophotographic image forming apparatus.

BACKGROUND

Electrophotographic printers with detachably mountable developer cartridges are well known in the art. These printers are sometimes provided with a new-product sensing means for detecting information on a mounted developer cartridge, such as whether the developer cartridge is new.

In one proposed laser printer, a sensor gear is rotatably provided on the developer cartridge. A contact protrusion is provided on the sensor gear for contacting an actuator in a main casing of the laser printer. When the developer cartridge is mounted in the main casing, the sensor gear is driven to rotate so that the contact protrusion causes the actuator to pivot. A photosensor detects this pivoting of the actuator, enabling the laser printer to acquire information on the developer cartridge based on the detection results.

SUMMARY

However, in the developer cartridge described above, the contact protrusion provided on the sensor gear protrudes from the side of the sensor gear opposite the developer cartridge. Consequently, if the contact protrusion comes into contact with external components while the developer cartridge is in transit or when the developer cartridge is being mounted in the main casing, for example, the protrusion and sensor gear could be damaged.

In view of the foregoing, it is an object of the present invention to provide a cartridge designed to reduce instances of damage caused to a pivot member when the cartridge is in transit.

In order to attain the above and other objects, there is provided a cartridge including: a casing that accommodates developer therein; a rotatable body rotatably provided at the casing; a pivot member; and a biasing member. The rotatable body is configured to rotate about a rotational axis upon receipt of a driving force, and has an outer circumference defining a rotational path during rotation. The pivot member is disposed at the rotatable body at a position offset from the rotational axis and configured to pivot about a pivot fulcrum extending in a direction parallel to a tangential direction of the rotational path, the pivot member being pivotably movable between an erect position in which the pivot member erects to form a first angle relative to the rotatable body and a collapsed position in which the pivot member pivots toward the rotatable body to form a second angle smaller than the first angle relative to the rotational body. The biasing member is configured to bias the pivot member toward the erect position.

BRIEF DESCRIPTION OF THE DRAWINGS

The particular features and advantages of the invention as well as other objects will become apparent from the following description taken in connection with the accompanying drawings, in which:

FIGS. 4 through 6 are views explaining a process to detect whether or not the developing cartridge according to the first embodiment is new, wherein:

FIG. 4 shows a state in which the developing cartridge according to the first embodiment has just been mounted in a main casing of the printer and the detecting-target protrusion is in its initial position;

FIG. 5 shows a state after FIG. 4 in which the detecting-target protrusion is in contact with an actuator provided in the main casing; and FIG. 6 shows a state after FIG. 5 in which the detecting-target protrusion is in its final position;

DETAILED DESCRIPTION

<First Embodiment>

1. Overall Structure of a Printer

First, an overall structure of a printer 1 will be described with reference to FIG. 1.

Figure 1:
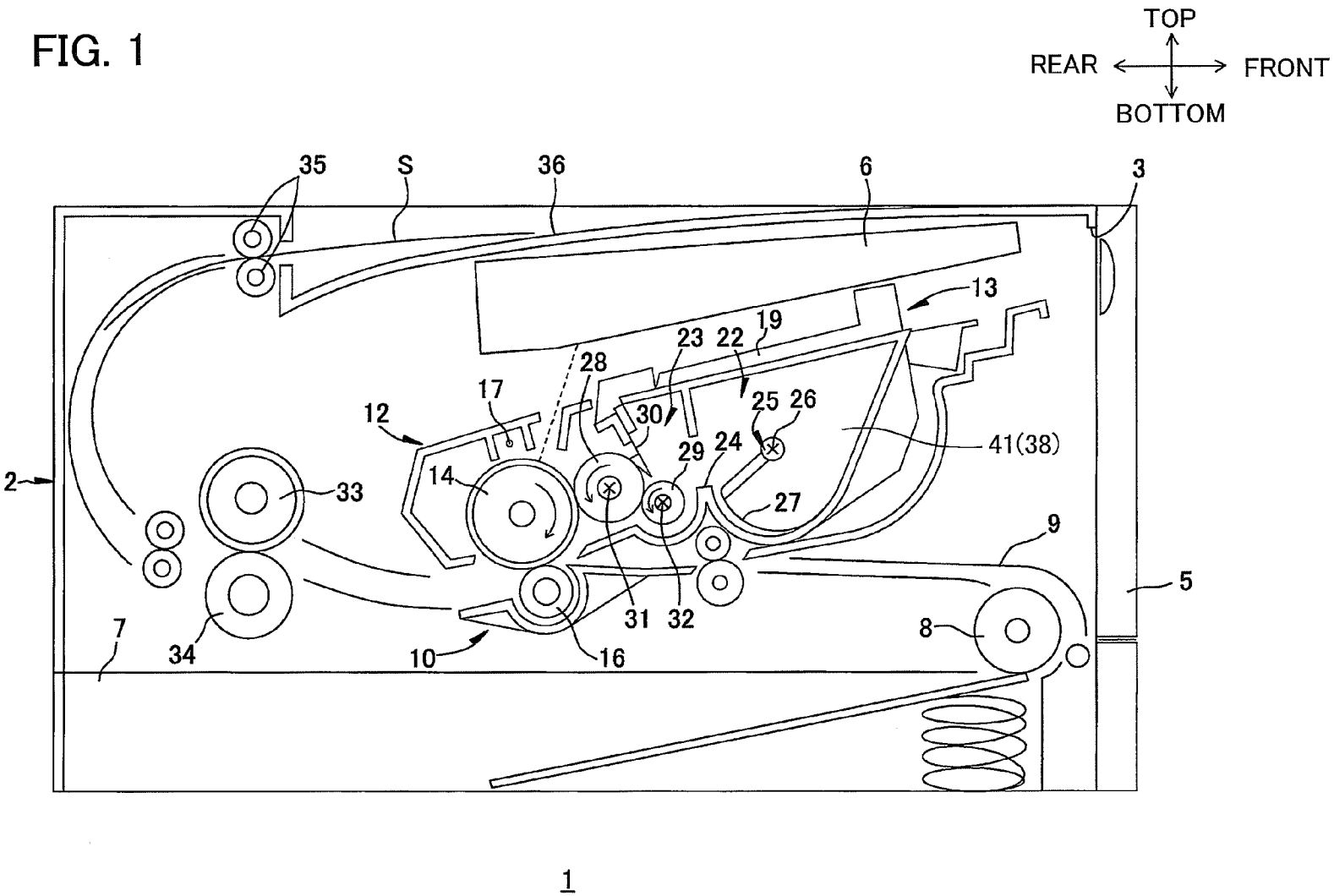
FIG. 1 is a vertical cross-sectional view of a printer that accommodates therein a developing cartridge according to a first embodiment of the present invention.

As shown in FIG. 1, the printer 1 includes a main casing 2 that is substantially box-shaped. A front cover 5 is provided on one side wall of the main casing 2. The front cover 5 can be pivoted open and closed around its bottom edge to expose and cover an access opening 3 formed in the one side of the main casing 2.

In the following description, the side of the main casing 2 on which the front cover 5 is provided (the right side in FIG. 1) will be called the "front side," and the opposite side (the left side in FIG. 1) will be called the "rear side." Further, the left and right sides of the main casing 2 will be defined based on the perspective of a user facing the front side of the printer 1. In addition, front, rear, left, right, top, and bottom sides of a developing cartridge 13 (described later) will be defined based on the mounted state of the developing cartridge 13 relative to the main casing 2.

The printer 1 is provided with a process cartridge 10. The process cartridge 10 includes a drum cartridge 12 that is detachably mountable in the main casing 2, and the developing cartridge 13 according to a first embodiment of the present invention that is detachably mountable on the drum cartridge 12.

The drum cartridge 12 includes a photosensitive drum 14, and a scorotron charger 17 that confronts the photosensitive drum 14 from the top thereof.

The developing cartridge 13 includes a developer frame 19 serving as an outer casing. A toner-accommodating chamber 22 and a developing chamber 23 are formed in the developer frame 19 and aligned in the front-to-rear direction. The toner-accommodating chamber 22 and developing chamber 23 are in communication with each other via a through-hole 24.

The toner-accommodating chamber 22 is filled with a positive-charging, nonmagnetic, single-component toner (developer). An agitator 25 is disposed in the toner-accommodating chamber 22 at a position in approximately the vertical and front-rear center thereof.

The agitator 25 includes an agitator shaft 26 extending in the left-right direction, and an agitating blade 27 extending radially outward from the agitator shaft 26. The agitator 25 rotates about a central axis of the agitator shaft 26.

Provided in the developing chamber 23 are a developing roller 28, a supply roller 29, and a thickness-regulating blade 30.

The developing roller 28 includes a metal developing-roller shaft 31 that is oriented in the left-right direction. The developing roller 28 is disposed in a rear end portion of the developer frame 19 so as to be exposed at a rear side of the developing chamber 23. The developing roller 28 rotates about a central axis of the developing-roller shaft 31.

The supply roller 29 includes a metal supply-roller shaft 32 that is oriented in the left-right direction. The supply roller 29 is disposed so as to contact a lower front side surface of the developing roller 28. The supply roller 29 rotates about a central axis of the supply-roller shaft 32.

The thickness-regulating blade 30 contacts an upper front side surface of the developing roller 28. The agitator 25 rotates to supply toner from the toner-accommodating chamber 22 through the through-hole 24 and onto the supply roller 29 disposed in the developing chamber 23. The supply roller 29 rotates to further supply this toner onto the developing roller 28. At this time, the toner is positively tribocharged between the supply roller 29 and developing roller 28. The thickness-regulating blade 30 regulates a thickness of toner on the developing roller 28 so that the developing roller 28 carries a uniform thin layer on its surface.

In the meantime, the scorotron charger 17 applies a uniform positive charge to the surface of the photosensitive drum 14 as the photosensitive drum 14 rotates. A scanning unit 6 disposed in a top section of the main casing 2 selectively irradiates a laser beam (see a broken line in FIG. 1) onto the positively-charged surface of the photosensitive drum 14, forming an electrostatic latent image thereon based on image data.

Next, the positively charged toner carried on the surface of the developing roller 28 is supplied to the electrostatic latent image formed on the surface of the photosensitive drum 14, developing the latent image into a toner image.

A paper tray 7 is detachably mounted in a bottom section of the main casing 2. The paper tray 7 accommodates sheets of paper S. A pickup roller 8 picks up the sheets S in the paper tray 7 and conveys the sheets S one sheet at a time along a U-shaped paper-conveying path 9. The pickup roller 8 feeds each sheet S at a prescribed timing between the photosensitive drum 14 and a transfer roller 16. The sheet S is conveyed rearward between the photosensitive drum 14 and transfer roller 16. At this time, the toner image carried on the photosensitive drum 14 is transferred onto the sheet S.

Subsequently, the sheet S passes between a heating roller 33 and a pressure roller 34, at which time the image transferred onto the sheet S is fixed to the sheet S by heat and pressure. Next, the sheet S is conveyed toward discharge rollers 35. The discharge rollers 35 discharge the sheet S onto a discharge tray 36 formed on a top surface of the main casing 2.

2. Detailed Description of the Developer Cartridge.

Next, a detailed structure of the developing cartridge 13 according to the first embodiment of the present invention will be described with reference to FIGS. 2 to 7.

Figure 2:
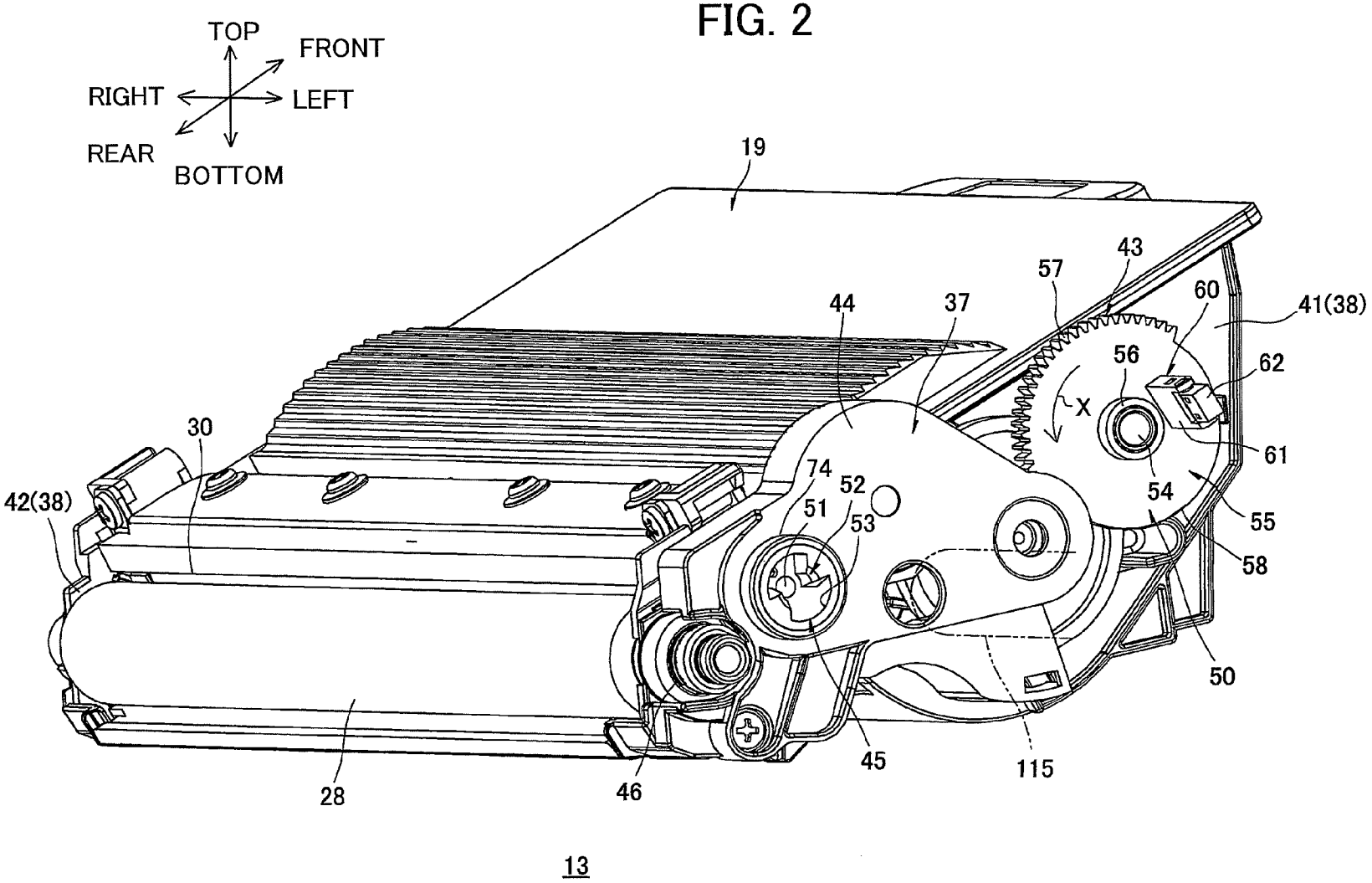
FIG. 2 is a perspective view of the developing cartridge of FIG. 1 as viewed from its rear side and left side, the developing cartridge including a reset gear.

As shown in FIG. 2, the developing cartridge 13 includes a drive and detection unit 37 disposed on the left side of the developer frame 19.

(1) Developer Frame

The developer frame 19 has a generally box shape and is elongated in the left-right direction. The developer frame 19 has a pair of side walls 38 arranged parallel to each other and spaced apart in the left-right direction. The side walls 38 include a first side wall 41 on the left side, and a second side wall 42 on the right side.

(2) Drive and Detection Unit

The drive and detection unit 37 is disposed on an outer surface (left side surface) of the first side wall 41. The drive and detection unit 37 includes a gear assembly 43, and a gear cover 44.

(2-1) Gear Assembly

The gear assembly 43 is configured of an input gear 45, a developing gear 46, a gear train (not shown), and a reset gear 50.

(2-1-1) Input Gear

The input gear 45 is rotatably provided on an upper rear end portion of the first side wall 41. The input gear 45 is capable of rotating about an input-gear shaft 51 oriented in the left-right direction. The input-gear shaft 51 is retained in the first side wall 41 so as to be incapable of rotating relative to the same. The input gear 45 has a generally columnar shape and extends in the left-right direction. The input gear 45 is integrally provided with a gear part (not shown) and a coupling part 52.

The gear part constitutes a right side portion of the input gear 45. Gear teeth are formed around the entire peripheral surface of the gear part.

The coupling part 52 constitutes a left side portion of the input gear 45. The coupling part 52 is generally cylindrical in shape with the same central axis as the gear part. A coupling recess 53 is formed in a left side surface of the coupling part 52. A device-side coupling 115 is provided in the main casing 2 (indicated by double-dotted chain line in FIG. 2) for coupling with the coupling recess 53 when the developing cartridge 13 is mounted in the main casing 2. Specifically, a distal end of the device-side coupling 115 is inserted into (engaged with or fitted into) the coupling recess 53 when the developing cartridge 13 is mounted in the main casing 2 so as to be incapable of rotating relative to the coupling recess 53. The main casing 2 inputs a drive force into the coupling recess 53 via the device-side coupling 115, driving the input gear 45 to rotate clockwise in a left side view (see FIG. 5).

(2-1-2) Developing Gear

The developing gear 46 is disposed below and rearward of the input gear 45. The developing gear 46 is assembled on a left end of the developing-roller shaft 31 and is incapable of rotating relative thereto. Gear teeth are formed around the entire peripheral surface of the developing gear 46. Gear teeth positioned in an upper front side of the developing gear 46 engage with the gear part of the input gear 45. Thus, when the main casing 2 inputs a drive force into the input gear 45, the developing gear 46 is driven to rotate counterclockwise in a left side view (see FIG. 5).

(2-1-3) Gear Train

The gear train (not shown) is arranged frontward of the input gear 45. The gear train is configured of various gears known in the art that are intermeshed with one another, including a supply gear, an intermediate gear, and an agitator gear (all not shown in the drawings). The supply gear is mounted on a left end of the supply-roller shaft 32 so as to be incapable of rotating relative thereto. The agitator gear is mounted on a left end of the agitator shaft 26 so as to be incapable of rotating relative thereto. The agitator gear has gear teeth 47 denoted by a double-dotted chain line in FIG. 4.

Figure 5:
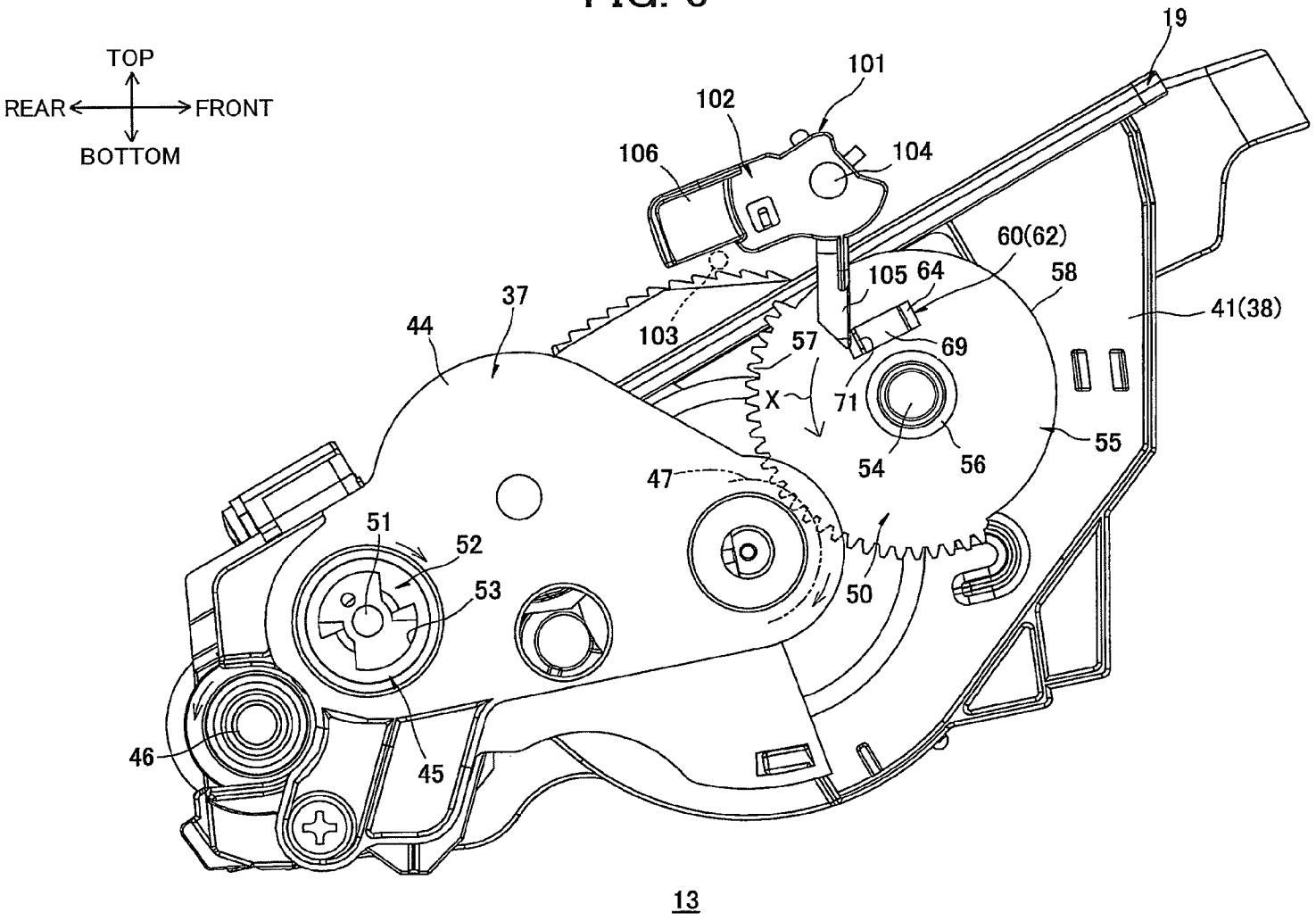

The gear train functions to transmit the drive force inputted into the input gear 45 to the supply gear and to transmit the same drive force to the agitator gear via the intermediate gear, driving the agitator gear to rotate clockwise in a left side view (see FIG. 5).

(2-1-4) Reset Gear

The reset gear 50 is rotatably disposed frontward of the gear train. The reset gear 50 can rotate about a rotational shaft 54 oriented in the left-right direction. The rotational shaft 54 is retained in the first side wall 41 so as to be incapable of rotating relative thereto. The reset gear 50 is a gear member integrally configured of a sector gear part 55, and a boss 56. The sector gear part 55 is generally disc-shaped and has a considerable thickness in the left-right direction. The sector gear part 55 shares a central axis with the rotational shaft 54. The sector gear part 55 has a peripheral surface on a portion of which gear teeth are formed such that the portion has a central angle of about 130 degrees. More specifically, the peripheral surface of the sector gear part 55 is configured of a toothed portion 57 having gear teeth formed thereon, and a toothless portion 58 having no gear teeth. Depending on the rotational position of the reset gear 50, the toothed portion 57 can engage with the gear teeth 47 formed on the agitator gear from the rear side thereof. On the other hand, the toothless portion 58 does not engage with the gear teeth 47 of the agitator gear.

The boss 56 has a generally cylindrical shape, extending leftward from a left surface of the sector gear part 55. The boss 56 shares its central axis with the sector gear part 55. The rotational shaft 54 is inserted through the boss 56 and is capable of rotating relative thereto.

With this construction, the reset gear 50 is rotatably supported about the rotational shaft 54. When the drive force inputted into the input gear 45 is transmitted to the reset gear 50 via the gear train, the reset gear 50 is driven to rotate about a central axis L (see FIG. 3) of the rotational shaft 54 in a rotating direction X (counterclockwise in a left side view) indicated by an arrow in FIG. 2.

(2-2) Detecting-Target Protrusion

A detecting-target protrusion 60 is provided on the left side surface of the sector gear part 55 (the side opposite the first side wall 41).

In the following description, top, bottom, front, rear, left, and right sides of the sector gear part 55 are defined based on the state of the sector gear part 55 in an initial position described later (see FIGS. 2 through 4).

The detecting-target protrusion 60 is disposed apart from but confronts the front side of the boss 56 (outward of the boss 56 in a radial direction of the reset gear 50). The detecting-target protrusion 60 is provided on a portion of the sector gear part 55 whose peripheral surface constitutes a part of the toothless portion 58. Hence, the detecting-target protrusion 60 is disposed at a position on the sector gear part 55 offset from its central rotational center (the central axis L of the rotational shaft 54).

Figures 3A, 3B:
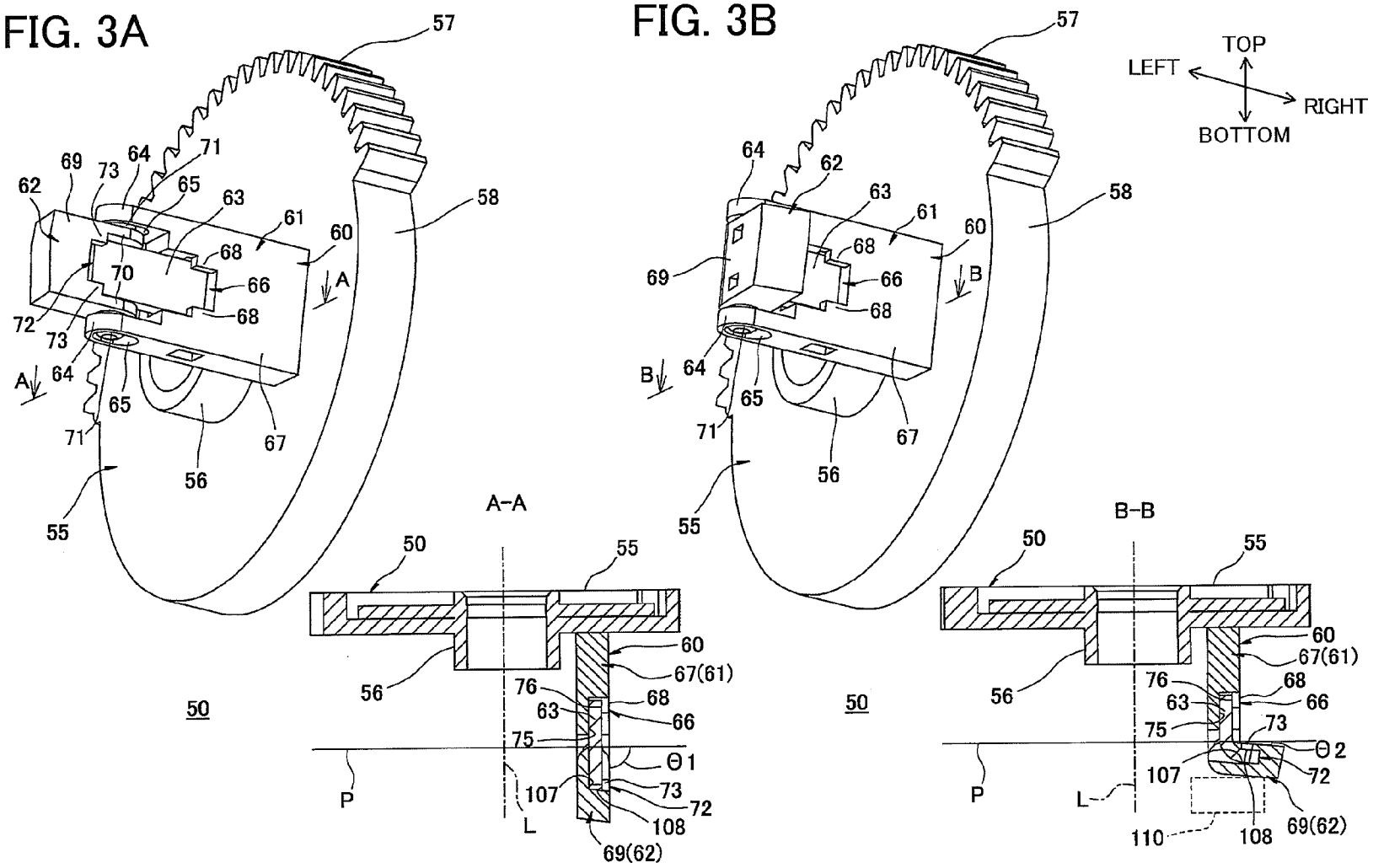
FIG. 3A is a perspective view of the reset gear of FIG. 2 as viewed from its rear side and left side, wherein a detecting-target protrusion is in an erect position.
FIG. 3B is a perspective view of the reset gear of FIG. 2 as viewed from its rear side and left side, wherein the detecting-target protrusion is in a collapsed position.

As shown in FIG. 3A, the detecting-target protrusion 60 includes a body part 61, a pivoting part 62, and an elastic member 63.

The body part 61 is integrally formed of a base part 67, and a pair of support parts 64.

The base part 67 has a generally flat plate-like shape and protrudes leftward from the left side surface of the sector gear part 55. The base part 67 is oriented along a direction parallel to a direction T that is tangential to a rotational path R of the sector gear part 55 (see FIG. 4; hereinafter simply called as the tangential direction T).

A first retaining part 66 is formed in the base part 67. The first retaining part 66 is formed by cutting out a portion from a left end of the base part 67, the portion being generally rectangular in a front side view and including a front surface of the left end of the base part 67 that is positioned at substantially center thereof in the vertical direction (an outer surface in a radial direction of the reset gear 50) and a left end surface connected to this front surface. The first retaining part 66 is thus formed with a front surface 75. One retaining protrusion 68 is provided on each of upper and lower ends of the first retaining part 66. The retaining protrusions 68 have rear surfaces 76 that are separated from the front surface 75 of the first retaining part 66.

The support parts 64 are generally plate-shaped and protrude leftward from both upper and lower portions on the left end of the base part 67. The support parts 64 are separated from each other in the vertical direction.

A fitting hole 65 is formed in each of the support parts 64, penetrating the corresponding support part 64 vertically. The fitting hole 65 has a generally elliptical cross section. The minor axis of the elliptical fitting hole 65 is substantially equivalent to an outer diameter of fitting protrusions 71 (described later). Forming the fitting holes 65 to have an elliptical cross section can more effectively reduce wear of the pivoting part 62.

Specifically, when the developing cartridge 13 is in transit or when the developing cartridge 13 is mounted in the main casing 2, for example, an external member, such as a member 110 (shown by a broken line in FIG. 3B) may contact the pivoting part 62, causing the fitting protrusions 71 (described later) to move along a longitudinal direction of the elliptically-shaped fitting holes 65 (i.e., left-right direction). In this way, the pivoting part 62 can effectively absorb impacts caused by interference with external members, reducing instances of damage imparted to the detecting-target protrusion 60.

The pivoting part 62 is integrally formed of a contact part 69, and a pair of supported parts 70.

The contact part 69 has a generally flat plate shape and is formed with a vertical dimension substantially equivalent to the vertical gap between the support parts 64. A second retaining part 72 is formed in the contact part 69.

The second retaining part 72 is formed by cutting out a portion from a right end of the contact part 69, the portion being substantially rectangular in a front side view and including a front surface of the right end of the contact part 69 that is positioned at substantially center thereof in the vertical direction (outer surface in the radial direction of the reset gear 50) and a right end surface connected to this front surface. The second retaining part 72 is thus formed with a front surface 107A. The retaining protrusion 73 is provided on each of upper and lower edges of the second retaining part 72. The retaining protrusions 73 have rear surfaces 108 that are separated from the front surface 107 of the second retaining part 72.

The supported parts 70 have a generally flat plate shape and protrude rightward from top and bottom portions on the right end of the contact part 69. The fitting protrusions 71 are formed on respective outer surfaces of the supported parts 70 in the vertical direction. More specifically, the upper fitting protrusion 71 protrudes upward from a top surface of the upper supported part 70, and the lower fitting protrusion 71 protrudes downward from a bottom surface of the lower supported part 70. Each fitting protrusion 71 has a generally circular cross section. Distal ends of the fitting protrusions 71 are generally arc-shaped in cross section. Hence, the contact part 69 is formed to protrude outward in a radial direction of the fitting protrusions 71 (leftward).

By inserting the fitting protrusions 71 of the supported parts 70 into the fitting holes 65 formed in the respective support parts 64 of the body part 61 from the inside toward the outside thereof, the pivoting part 62 is pivotally movably supported to the body part 61 so as to be capable of pivotably moving about the fitting protrusions 71. In other words, since the pivoting part 62 is oriented along the tangential direction T of the sector gear part 55 (see FIG. 4), each of the fitting protrusions 71 is also provided along the tangential direction T of the sector gear part 55.

With this configuration, the pivoting part 62 is movable between an erect position (the state shown in FIG. 3A) in which the contact part 69 extends leftward from the left end of the body part 61 (support parts 64), and a collapsed position (the state shown in FIG. 3B) in which the distal end of the contact part 69 is pivoted toward the sector gear part 55 from the erect position. In other words, the pivoting part 62 can pivotally move between the erect position erected to form an angle with the reset gear 50, and the collapsed position pivoted toward the reset gear 50 so as to form a smaller angle with the reset gear 50 than in the erect position.

More specifically, in the erect position shown in FIG. 3A, an angle θ1 of 70-110 degrees, for example, is formed between the contact part 69 and an imaginary plane P that passes through a pivot center of the pivoting part 62 and that is parallel to the radial direction of the sector gear part 55, the angle θ1 being an angle formed at a side opposite to the central axis L with respect to the contact part 69.

When the pivoting part 62 is in the collapsed position shown in FIG. 3B, the contact part 69 is pivoted toward the sector gear part 55 so as to form an angle θ2 between the imaginary plane P and the contact part 69 such that the angle θ2 is smaller than the angle θ1 in the erect position. This angle θ2 is 0-69 degrees, for example.

Incidentally, the cross section A-A in FIG. 3A and the cross section B-B in FIG. 3B include the rotational axis of the reset gear 50 (the central axis L) and are orthogonal to the pivot axis of the pivoting part 62. Further, the imaginary plane P is at least defined as intersecting the central axis L at the same point when the pivoting part 62 is in the erect position and in the collapsed position.

The elastic member 63 is generally rectangular in a front side view and is elongated in the left-right direction. The elastic member 63 is formed of a rubber material or the like. The elastic member 63 has a right portion that is accommodated in the first retaining part 66 of the base part 67 and interposed between the front surface 75 of the first retaining part 66 and the rear surfaces 76 of the retaining protrusions 68. The elastic member 63 has a left portion that is accommodated in the second retaining part 72 of the contact part 69 and interposed between the front surface 107 of the second retaining part 72 and the rear surfaces 108 of the retaining protrusions 73. In this way, the elastic member 63 is retained by the body part 61 and the pivoting part 62. Elastic force of the elastic member 63 constantly urges the pivoting part 62 toward the erect position.

(2-3) Gear Cover

As shown in FIG. 2, the gear cover 44 has a generally cylindrical shape that extends in the left-right direction and is closed on its left side. The gear cover 44 is formed large enough (with sufficient front-rear and vertical dimensions) to cover the input gear 45 and the entire gear train.

The gear cover 44 has a left wall on which a coupling-exposure hole 74 is formed. The coupling-exposure hole 74 is generally circular shape in a side view and penetrates through the left wall of the gear cover 44 near the rear end thereof in order to expose the left surface of the coupling part 52 constituting the input gear 45. With this configuration, the gear cover 44 covers the input gear 45 (excluding the left surface of the coupling part 52) and the entire gear train, while the left surface of the coupling part 52 is exposed through the coupling-exposure hole 74. The gear cover 44 is fastened to the first side wall 41 with screws (not shown).

3. Detailed Description of the Main Casing

Figure 4:
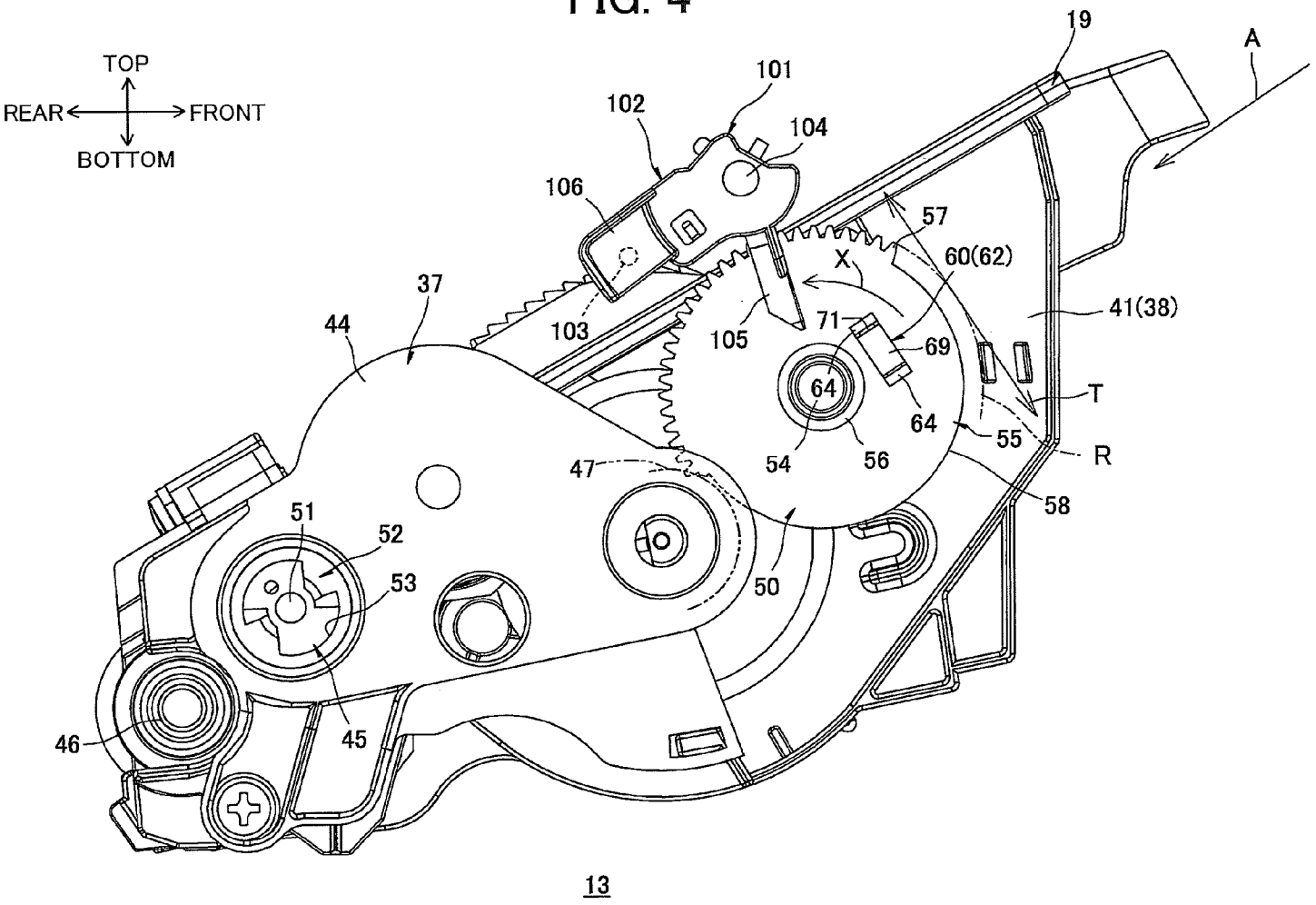

As shown in FIG. 4, a sensing mechanism 101 is provided in the main casing 2 for detecting the detecting-target protrusion 60. The sensing mechanism 101 includes an actuator 102, and a photosensor 103 configured of a light-emitting element and a light-receiving element.

The actuator 102 integrally includes a pivoting shaft 104 oriented in the left-right direction, a contact lever 105 extending downward from the pivoting shaft 104, and a light-shielding lever 106 extending rearward from the pivoting shaft 104.

The pivoting shaft 104 is rotatably supported in inner wall sections (not shown) of the main casing 2, for example. The contact lever 105 and the light-shielding lever 106 are arranged to form an angle of approximately 80 degrees about the pivoting shaft 104.

The actuator 102 is capable of pivoting between a non-detecting position (the state in FIG. 4) in which the contact lever 105 extends diagonally downward and forward from the pivoting shaft 104 and the light-shielding lever 106 extends diagonally downward and rearward from the pivoting shaft 104, and a detecting position (the state shown in FIG. 5) in which the contact lever 105 extends downward and the light-shielding lever 106 extends rearward. Due to a biasing force of a spring (not shown), the actuator 102 is biased into the non-detecting position while an external force other than the biasing force is not applied to the actuator 102.

The photosensor 103 includes the light-emitting element and the light-receiving element that are arranged so as to oppose each other in the left-right direction. The photosensor 103 is positioned such that the light-shielding lever 106 blocks a path of light from the light-emitting element to the light-receiving element when the actuator 102 is in the non-detecting position and does not block the light path when the actuator 102 is in the detecting position. When the light-shielding lever 106 is retracted from the light path between the light-emitting element and light-receiving element (see FIG. 5), the photosensor 103 outputs an ON signal. Note that the photosensor 103 is electrically connected to a microcomputer (not shown).

4. Operations for Mounting and Removing the Developer Cartridge and for Detecting a New Developer Cartridge (4-1) Operation for Mounting the Developer Cartridge in the Main Casing As shown in FIG. 2, the reset gear 50 of a new developing cartridge 13 is disposed in the initial position in which the detecting-target protrusion 60 is positioned diagonally above and forward of the boss 56. At this time, the teeth in the toothed portion 57 of the reset gear 50 positioned farthest downstream in the rotating direction X are engaged with the gear teeth 47 of the agitator gear.

To mount a new developing cartridge 13 into the main casing 2 (the drum cartridge 12), an operator opens the front cover 5 and inserts the developing cartridge 13 from the front side of the printer 1 into the main casing 2 through the access opening 3 (see FIG. 1). As shown in FIG. 4, a mounting direction A in which the developing cartridge 13 is mounted into the main casing 2 intersects (is substantially orthogonal to) the direction in which the fitting protrusions 71 protrude from the pivoting part 62 of the detecting-target protrusion 60.

At this time, the elastic member 63 constantly urges the pivoting part 62 of the detecting-target protrusion 60 into the erect position. However, if the pivoting part 62 contacts the member 110 in the main casing 2 (or the main casing 2 itself), as shown in FIG. 3B, the pivoting part 62 pivots forward from the erect position into the collapsed position. Hence, when the developing cartridge 13 is mounted in the main casing 2, the detecting-target protrusion 60 is not damaged even if the pivoting part 62 contacts the member 110, and the developing cartridge 13 can be smoothly mounted in the main casing 2.

Once the pivoting part 62 separates from the member 110, the elastic force of the elastic member 63 returns the pivoting part 62 to the erect position (see FIG. 4). After the operator subsequently closes the front cover 5, the operation for mounting the developing cartridge 13 in the main casing 2 is complete.

(4-2) Operation for Detecting a New Developer Cartridge

The printer 1 initiates a warm-up operation after the developing cartridge 13 is mounted in the main casing 2. During the warm-up operation, the distal end of the device-side coupling 115 is inserted into the coupling part 52 (coupling recess 53) of the input gear 45, as shown in FIG. 2. Next, a drive force is inputted from the device-side coupling 115 into the input gear 45 for rotating the input gear 45. The rotation of the input gear 45 drives the developing gear 46 and the various gears of the gear train, including the supply gear, the intermediate gear, and the agitator gear (the gear teeth 47), to rotate, thereby driving the developing roller 28, the supply roller 29, and the agitator 25 to rotate (see FIG. 1).

If the developing cartridge 13 is a new product, the gear teeth 47 on the agitator gear are engaged with the toothed portion 57 of the reset gear 50. Accordingly, the drive force inputted into the input gear 45 and transmitted via the gear train drives the reset gear 50 to rotate in the rotating direction X (counterclockwise in a left side view). Prior to mounting a new developing cartridge 13 in the main casing 2 and immediately after mounting the new developing cartridge 13, the actuator 102 is in the non-detecting position shown in FIG. 4. Therefore, the light-shielding lever 106 blocks the light path of the photosensor 103, causing the photosensor 103 to output an OFF signal.

As the reset gear 50 rotates upon receipt of the driving force, the detecting-target protrusion 60 moves in the rotating direction X. Consequently, the contact part 69 of the detecting-target protrusion 60 contacts the contact lever 105 such that an extending direction of the contact lever 105 intersects with a protruding direction of the fitting protrusions 71. The reset gear 50 continues to rotate. The contact part 69 pushes the contact lever 105 rearward, forcing the actuator 102 to pivot from the non-detecting position to the detecting position, as shown in FIG. 5. Note that, the pivoting part 62 (contact part 69) contacts the contact lever 105 such that the pivoting direction of the contact lever 105 intersects the protruding direction of the fitting protrusions 71. Therefore, the pivoting part 62 pushes the contact lever 105 without being displaced from the erect position.

As a result, the light-shielding lever 106 is retracted from the light path extending from the light-emitting element to the light-receiving element of the photosensor 103, and the photosensor 103 outputs an ON signal. In this way, the photosensor 103 can detect the detecting-target protrusion 60.

As the reset gear 50 continues to rotate, the contact part 69 separates from the contact lever 105, at which time the actuator 102 pivots from the detecting position back to the non-detecting position. Consequently, the light-shielding lever 106 again blocks the light path of the photosensor 103, and the output signal from the photosensor 103 changes from an ON signal to an OFF signal.

Figure 6:
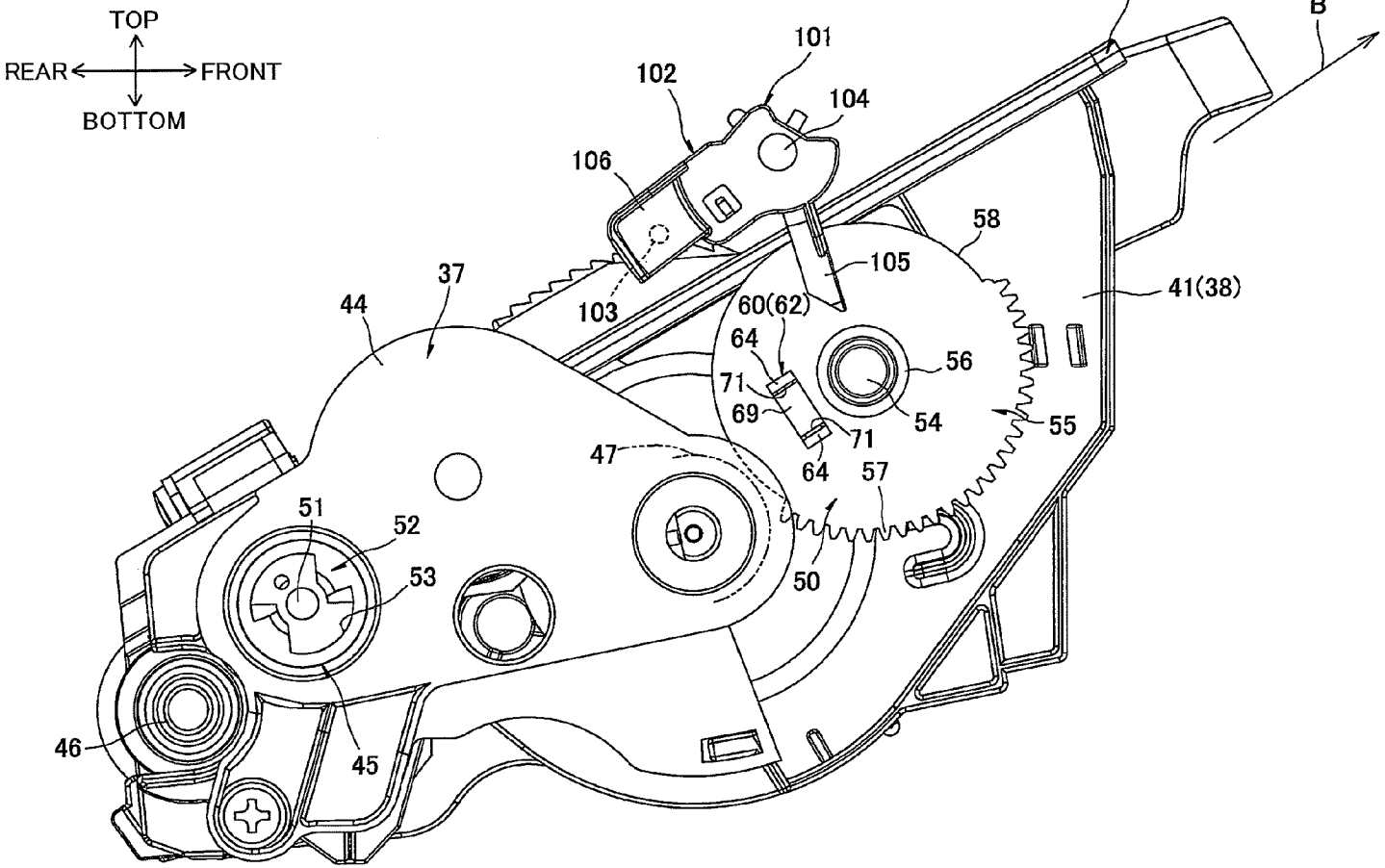

As the reset gear 50 continues to rotate, the toothed portion 57 of the reset gear 50 disengages from the gear teeth 47 on the agitator gear, as illustrated in FIG. 6. At this time, the toothless portion 58 of the reset gear 50 opposes the gear teeth 47 of the agitator gear, thereby halting rotation of the reset gear 50. Here, the reset gear 50 is in a final position.

Thus, when a new developing cartridge 13 is first mounted in the main casing 2, the photosensor 103 outputs an ON signal. Hence, the printer 1 of the first embodiment can determine that the developing cartridge 13 is a new product when the photosensor 103 outputs an ON signal after the developing cartridge 13 is mounted in the main casing 2.

However, if a used developing cartridge 13 (a developing cartridge 13 that has been previously mounted in the main casing 2) is mounted in the main casing 2, the reset gear 50 does not rotate, even when the printer 1 initiates a warm-up operation, because the toothed portion 57 of the reset gear 50 is no longer engaged with the gear teeth 47 of the agitator gear. Accordingly, the printer 1 of the first embodiment can determine that the developing cartridge 13 is used when the photosensor 103 does not output an ON signal within a prescribed interval after the developing cartridge 13 has been mounted in the main casing 2.

(4-3) Operation for Removing the Developer Cartridge from the Main Casing

In a used developing cartridge 13, the reset gear 50 is disposed in the final position in which the detecting-target protrusion 60 is diagonally downward and rearward of the boss 56, as shown in FIG. 6. To remove a used developing cartridge 13 from the main casing 2 (drum cartridge 12), the operator performs the operation for mounting the developing cartridge 13 described above in reverse.

Figure 7:
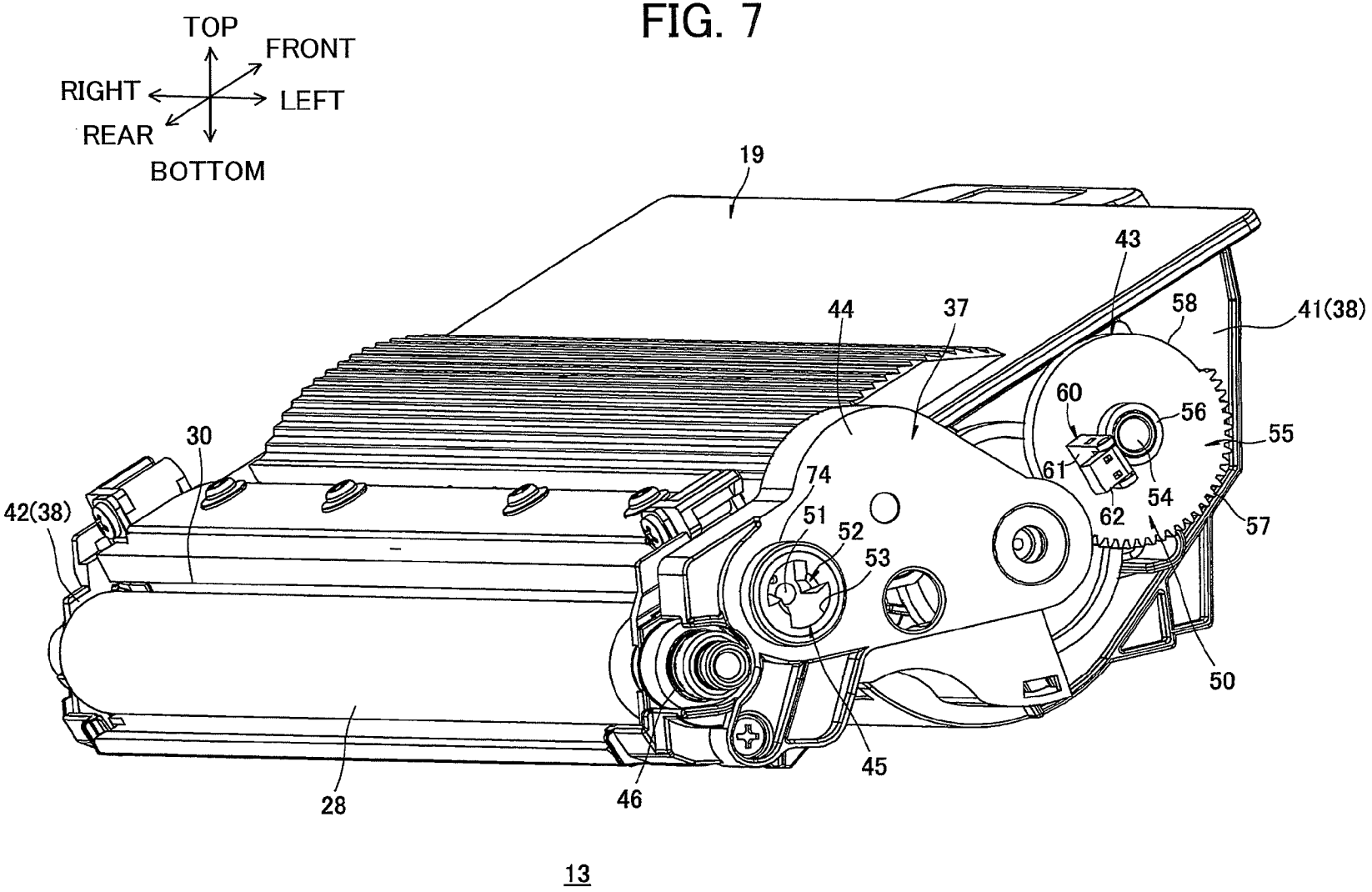
FIG. 7 is a perspective view of the developing cartridge of FIG. 1 as viewed from its rear side and left side, wherein the detecting-target protrusion at its final position is in the collapsed position.

Specifically, the operator opens the front cover 5 and pulls the developing cartridge 13 diagonally upward and forward (see FIG. 1). As shown in FIG. 6, a removal direction B shown in FIG. 6 in which the developing cartridge 13 is removed from the main casing 2 intersects (is substantially orthogonal to) the direction in which the fitting protrusions 71 protrude from the pivoting part 62 of the detecting-target protrusion 60. Hence, if the pivoting part 62 of the detecting-target protrusion 60 contacts the member 110 in the main casing 2 (or the main casing 2 itself), the pivoting part 62 is displaced rearward from the erect position into the collapsed position, as shown in FIG. 7.

5. Operational Advantages (1) As shown in FIG. 2, the reset gear 50 is provided on the developer frame 19 of the developing cartridge 13. The detecting-target protrusion 60 is provided on the reset gear 50, as shown in FIG. 3A, and includes the body part 61, the pivoting part 62, and the elastic member 63. The pivoting part 62 can pivot between the erect position and the collapsed position. In the erect position, the angle θ1 of 70-110 degrees, for example, is formed between the contact part 69 of the pivoting part 62 and the imaginary plane P that passes through the pivot center of the pivoting part 62 and that is parallel to the radial direction of the sector gear part 55. In the collapsed position, the contact part 69 of the pivoting part 62 is pivoted toward the sector gear part 55 so as to form the angle θ2 that is smaller than the angle θ1 in the erect position (0-69 degrees, for example).

Therefore, if an external member such as the member 110 contacts the pivoting part 62 while the developing cartridge 13 is in transit or when the developing cartridge 13 is being mounted into the main casing 2, for example, the pivoting part 62 can pivot from the erect position to the collapsed position. Accordingly, this construction can reduce the instances of damage imparted to the pivoting part 62 (detecting-target protrusion 60), even if the pivoting part 62 contacts such an external member.

Further, the elastic member 63 constantly biases the pivoting part 62 toward the erect position. As a result, the pivoting part 62 is in the erect position when the developing cartridge 13 is mounted in the main casing 2. Thus, this configuration ensures reliable contact between the pivoting part 62 and the actuator 102 of the sensing mechanism 101 provided in the main casing 2, thereby improving accuracy in detecting a new developing cartridge 13.

(2) Since the reset gear 50 is a gear member, the drive force inputted into the input gear 45 can be reliably transmitted to the reset gear 50 via the gear train (not shown). Accordingly, the reset gear 50 can be driven to rotate smoothly.

(3) The pivoting part 62 is integrally formed of the contact part 69 and the pair of supported parts 70. The contact part 69 has a generally flat plate shape, while the supported parts 70 have a generally flat plate shape and protrude rightward from the top and bottom ends on the right end of the contact part 69. In addition, the fitting protrusions 71 are formed on the respective outer surfaces of the supported parts 70 relative to the vertical direction. The fitting protrusions 71 are generally circular shape in a plan view and protrude vertically outward from respective outer surfaces on the top and bottom of the supported parts 70.

Hence, the contact part 69 is formed to protrude in the radial direction of the fitting protrusions 71 (leftward). Thus, this construction ensures reliable contact between the contact part 69 and the actuator 102, thereby improving the accuracy in detecting a new developing cartridge 13.

By inserting the fitting protrusions 71 of the supported parts 70 into the fitting holes 65 formed in the respective support parts 64 from the inside toward the outside thereof, the pivoting part 62 is pivotably movably supported to the body part 61 so as to be capable of pivotally moving about the fitting protrusions 71. Therefore, with the contact part 69 pivoting about the fitting protrusions 71, the pivoting part 62 can move smoothly from the erect position to the collapsed position when the contact part 69 contacts an external member. Thus, this construction reliably reduces instances of damage imparted to the pivoting part 62, even though the contact part 69 is formed to protrude in the radial direction of the fitting protrusions 71.

<Second Embodiment>

Next, a developer cartridge 213 according to a second embodiment of the present invention will be described with reference to FIGS. 7 and 8. Note that in the following descriptions, up, down, front, rear, left, and right directions relative to the sector gear part 55 are defined based on directional arrows shown in the respective drawings (FIGS. 8 and 9).

Figure 8:
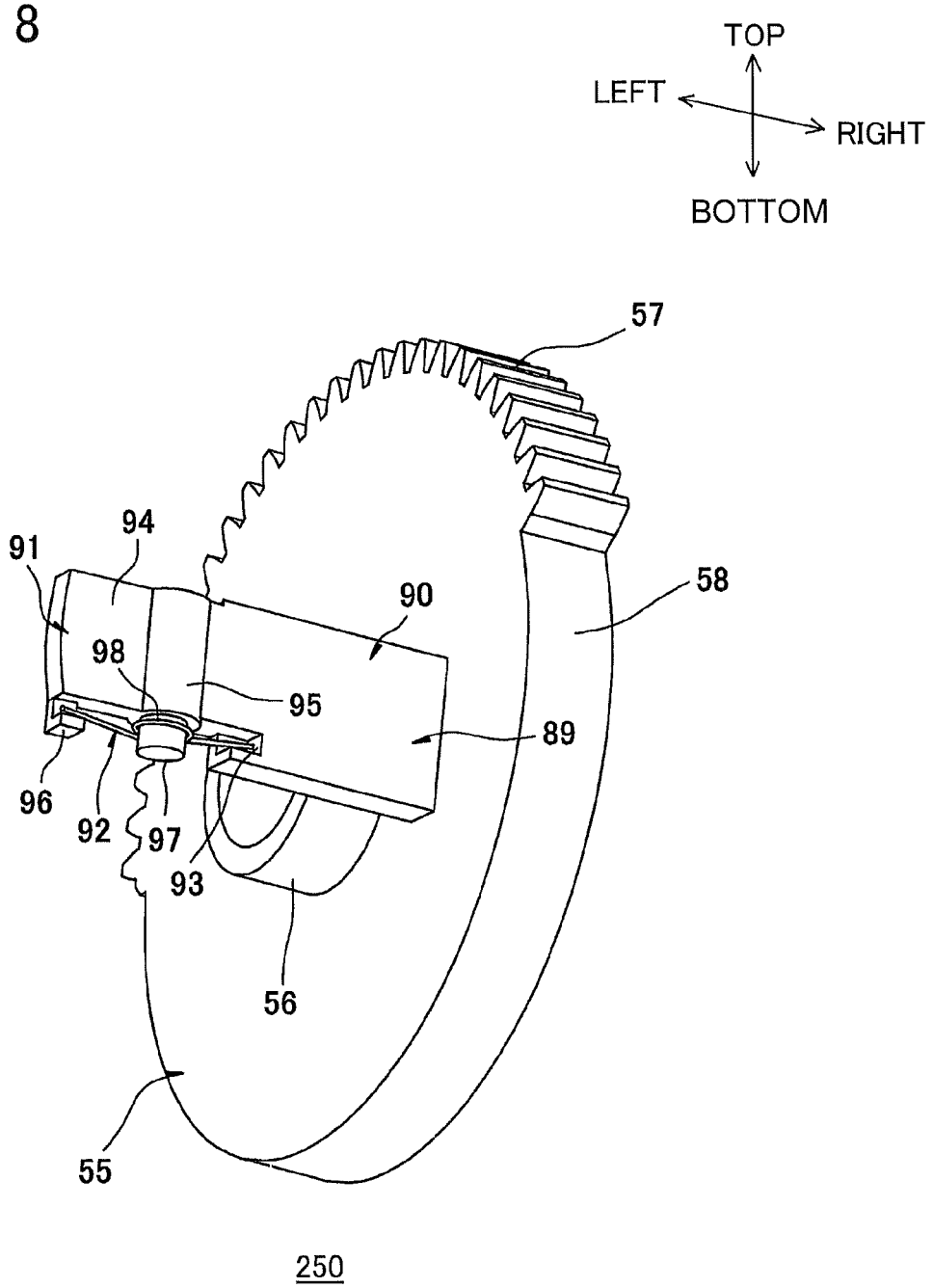
FIG. 8 is a perspective view of a reset gear provided at a developing cartridge according to a second embodiment of the present invention.

FIG. 8 shows a detecting-target protrusion 89 of a reset gear 250 provided in the developer cartridge 213 according to the second embodiment, where like parts and components are designated with the same reference numerals used in the first embodiment to avoid duplicating description.

In the second embodiment shown in FIG. 8, the detecting-target protrusion 89 includes a body part 90, a pivoting part 91, and a spring member 92.

The body part 90 has a generally flat plate shape and protrudes leftward from the left side surface of the sector gear part 55. The body part 90 is oriented along the tangential direction T of the sector gear part 55 (see FIG. 4). A first engaging part 93 is formed on a front surface of the body part 90. The first engaging part 93 is formed in a lower portion at the left end of the body part 90. The first engaging part 93 is generally rectangular in a front view and is in a form of a recess depressed rearward from the front surface of the body part 90.

The pivoting part 91 integrally includes a contact part 94 and a rotational shaft 95.

The contact part 94 has a generally flat plate shape and is generally rectangular in a front view. A second engaging part 96 is integrally formed on a bottom side of the contact part 94 at the left end thereof. The second engaging part 96 is L-shaped in a side view, extending downward from the bottom of the contact part 94 and then bending forward.

The rotational shaft 95 has a generally hollow cylindrical shape and is elongated vertically. The rotational shaft 95 has a left end portion that is connected to a right end portion of the contact part 94.

The rotational shaft 95 of the pivoting part 91 is supported on a left end portion of the body part 90 such that the pivoting part 91 is pivotally movable about a central axis of the rotational shaft 95. More specifically, a generally columnar-shaped shaft 97 is formed at the left end portion of the body part 90 such that an upper end portion of the shaft 97 is connected to an upper end portion of the left end portion of the body part 90. This shaft 97 has an outer diameter smaller than an inner diameter of the rotational shaft 95, and has a length longer than that of the rotational shaft 95 in the vertical direction. For assembling the pivoting part 91 to the body part 90, the rotational shaft 95 is coupled to the shaft 97 of the body part 90 from below such that the shaft 97 is fitted into an internal space of the rotational shaft 95. When the rotational shaft 95 has been assembled to the shaft 97 of the body part 90, a central axis of the shaft 97 is coincident with the rotational shaft 95. With this structure, the pivoting part 91 can be displaced between the erect position and the collapsed position described in the first embodiment.

When the rotational shaft 95 has been assembled to the shaft 97 of the body part 90, a bottom end portion of the shaft 97 protrudes downward from a bottom surface of the rotational shaft 95. This protruding portion of the shaft 97 serves as a coil retaining part 97 for retaining the spring member 92.

The spring member 92 is a torsion coil spring. A single-wound coil part 98 constitutes a mid-portion of the spring member 92. With the coil retaining part 97 inserted through the coil part 98, the right end of the spring member 92 is engaged in the first engaging part 93 of the body part 90, while the left end is engaged in the second engaging part 96 of the pivoting part 91. In this way, the spring member 92 is held by the body part 90 and pivoting part 91. With this configuration, the biasing force of the spring member 92 constantly biases the pivoting part 91 toward the erect position. Thus, the developer cartridge according to the second embodiment can obtain the same operational advantages as those in the first embodiment.

Incidentally, the detecting-target protrusion 60 in the first embodiment described above (see FIG. 3A) has the elastic member 63 formed of a rubber material or the like. However, the detecting-target protrusion 89 of the second embodiment includes the spring member 92. Therefore, through a simple structure the detecting-target protrusion 89 of the second embodiment can more reliably maintain the pivoting part 91 in the erect position than the detecting-target protrusion 60 of the first embodiment.

<Third and Fourth Embodiments>

Next, a reset gear 350 according to a third embodiment and a reset gear 450 according to a fourth embodiment of the present invention will be described with reference to FIGS. 9A and 9B, wherein like parts and components are designated with the same reference numerals used in the first embodiment to avoid duplicating description.

(1) Third Embodiment

Figure 9B:
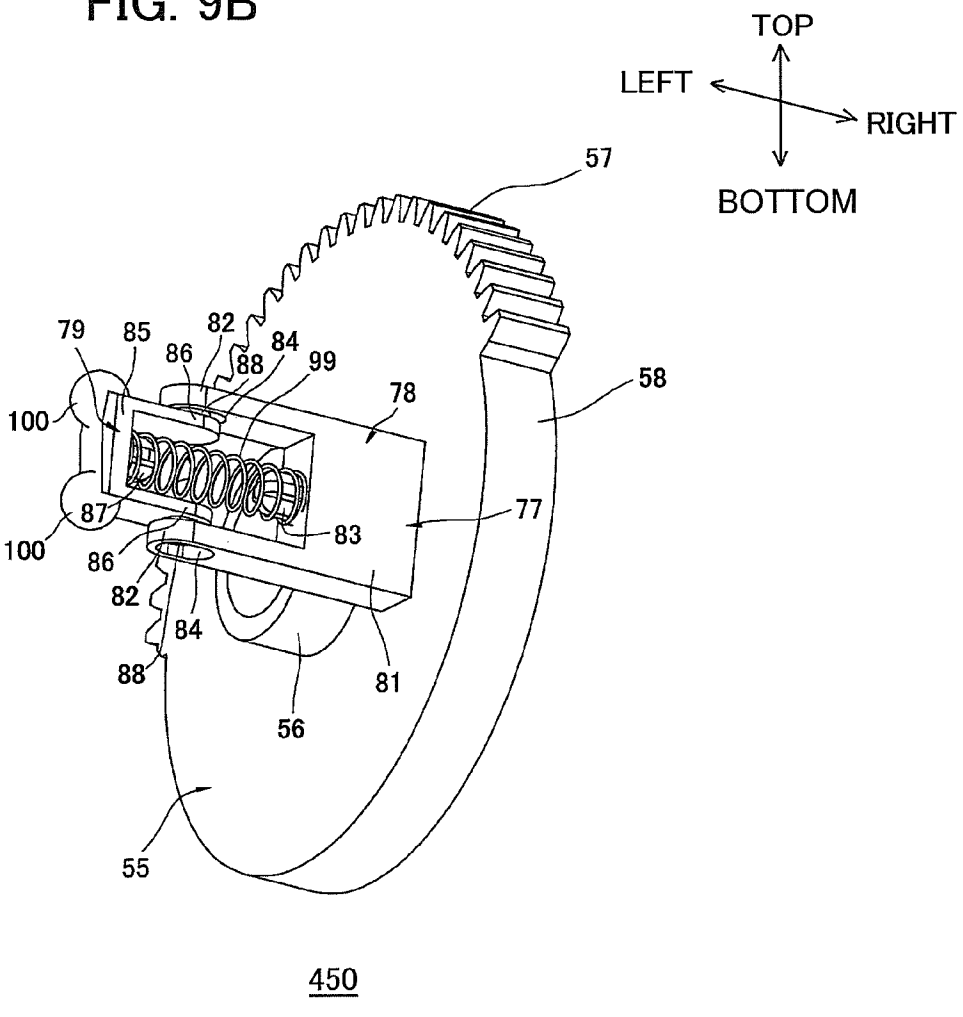
FIG. 9B is a perspective view of a reset gear provided at a developing cartridge according to a fourth embodiment of the present invention.
Figure 9A:
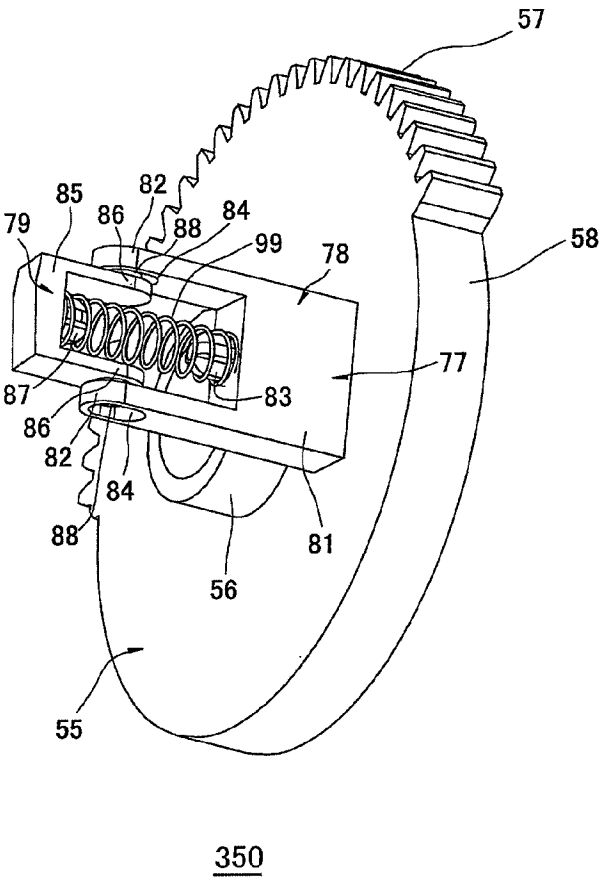
FIG. 9A is a perspective view of a reset gear provided at a developing cartridge according to a third embodiment of the present invention.

FIG. 9A shows a detecting-target protrusion 77 of the reset gear 350 according to the third embodiment.

In the third embodiment shown in FIG. 9A, the detecting-target protrusion 77 includes a body part 78, a pivoting part 79, and a coil spring 99.

The body part 78 is generally U-shaped in a front view, with an opening of the U-shape oriented toward the left side. The body part 78 integrally includes a base part 81 and a pair of support parts 82.

The base part 81 has a generally flat plate shape and protrudes leftward from the left side surface of the sector gear part 55. The base part 81 is oriented along the tangential direction T of the sector gear part 55 (see FIG. 4).

The support parts 82 have a generally flat plate shape and protrude leftward from both upper and lower portions on a left end of the base part 81. The support parts 82 are separated from each other in the vertical direction.

A fitting hole 84 is formed in a left end portion of each support part 82, penetrating the corresponding support part 82 vertically. The fitting holes 84 have a generally elliptical cross section. The fitting holes 84 has a minor axis that is substantially equivalent to an outer diameter of fitting protrusions 88 (described later), and a major axis that is greater than the outer diameter of the fitting protrusions 88.

The pivoting part 79 has a general U-shape in a front view, whose open end is oriented toward the right side. The pivoting part 79 integrally includes a contact part 85 and a pair of supported parts 86.

The contact part 85 is generally rectangular shaped in a front view and is elongated vertically. The contact part 85 has a vertical dimension that is substantially equivalent to the vertical gap between the support parts 82.

The supported parts 86 have a generally flat plate shape and protrude rightward from top and bottom ends on a right end of the contact part 85. Fitting protrusions 88 are formed on the respective upper and lower outer surfaces on the right ends of the corresponding supported parts 86. The fitting protrusions 88 have a protruding length shorter than that of the fitting protrusions 71 of the first embodiment.

By inserting the fitting protrusions 88 of the supported parts 86 into the fitting holes 84 formed in the support parts 82 of the body part 78 from the inside toward the outside thereof, the pivoting part 79 is pivotably movably supported on the body part 78 about the fitting protrusions 88. With this configuration, the pivoting part 79 can be displaced between the erect position and the collapsed position described in the first embodiment.

The coil spring 99 has a shape of an air-core coil and is elongated in the left-right direction. The coil spring 99 has a right end supported on a first retaining part 83, and a left end supported on a second retaining part 87.

The first retaining part 83 is disposed in the vertical center region on a left endface of the base part 81. The first retaining part 83 has a generally semicircular arc-shape in a front view and protrudes leftward from the left endface of the base part 81.

The second retaining part 87 is disposed in the vertical center region on a right endface of the contact part 85. The second retaining part 87 has a generally semicircular arc-shape in a front view and protrudes rightward from the right endface of the contact part 85.

Outer diameters of the first retaining part 83 and the second retaining part 87 are substantially equivalent to an inner diameter of the coil spring 99. With this construction, the coil spring 99 is retained in the detecting-target protrusion 77. Due to a biasing force of the coil spring 99, the pivoting part 91 is constantly urged toward the erect position. Thus, a developer cartridge provided with the detecting-target protrusion 77 according to the third embodiment can obtain the same operational advantages as the first embodiment.

Further, through a simple construction, the detecting-target protrusion 77 of the third embodiment can more reliably maintain the pivoting part 79 in the erect position than the detecting-target protrusion 60 of the first embodiment.

(2) Fourth Embodiment

In the fourth embodiment shown in FIG. 9B, spherical parts 100 are further provided on the contact part 85 of the detecting-target protrusion 77 of the third embodiment. The spherical parts 100 have a generally spherical shape and are provided on a left endface of the contact part 85, with one on either upper and lower ends thereof. With this construction, the same operational advantages as the first embodiment can be obtained.

In the fourth embodiment, the spherical parts 100 ensure that impacts impinged on the pivoting part 79 from external members are more likely to act in a direction for pivoting the pivoting part 79, regardless of the direction of the impact. Thus, this construction can more reliably pivotally move the pivoting part 79, further reducing instances of damage to the pivoting part 79 (detecting-target protrusion 77), and can ensure that the developing cartridge according to the fourth embodiment is smoothly mounted into and removed from the main casing 2.

<Fifth through Seventh Embodiments>

(1) Fifth Embodiment

Figure 10:
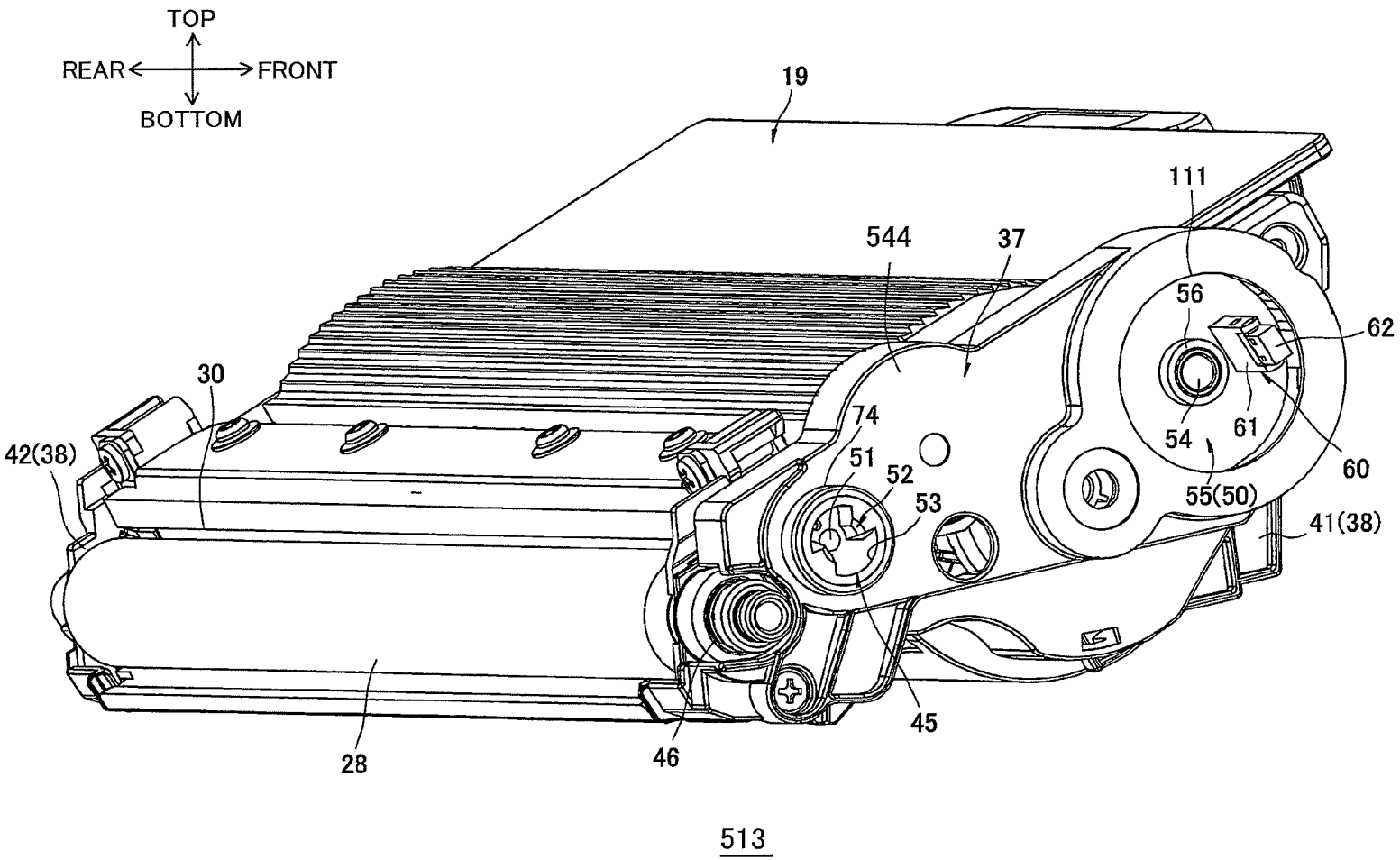
FIG. 10 is a perspective view of a developing cartridge according to a fifth embodiment of the present invention.

FIG. 10 shows a developer cartridge 513 according to a fifth embodiment, wherein like parts and components are designated with the same reference numerals as those used in the first embodiment to avoid duplicating description.

In the first embodiment shown in FIG. 2, the gear cover 44 is formed large enough (with sufficient front-rear and vertical dimensions) to cover the input gear 45 and the entire gear train (not shown). However, a gear cover 544 according to the fifth embodiment is formed large enough to cover the input gear 45, the entire gear train, and the reset gear 50.

Further, an exposure opening 111 is formed in the gear cover 544 for exposing the detecting-target protrusion 60. The exposure opening 111 is generally circular in a side view and penetrates the left wall of the gear cover 544 in a region on the front side thereof. The exposure opening 111 exposes most parts of the sector gear part 55, except for the toothed portion 57 and the toothless portion 58.

Hence, when the gear cover 544 is fastened to the first side wall 41 with screws, the left surface of the coupling part 52 constituting the input gear 45 is exposed through the coupling-exposure hole 74, and the detecting-target protrusion 60 of the reset gear 50 is exposed through the exposure opening 111 while the gear cover 44 covers the toothed portion 57 and toothless portion 58 of the sector gear part 55.

With the structure of the gear cover 544 according to the fifth embodiment, the gear cover 544 can prevent external members from contacting the toothed portion 57 and toothless portion 58 of the sector gear part 55, thereby reducing instances of damage to the same.

(2) Sixth Embodiment

Figure 11:
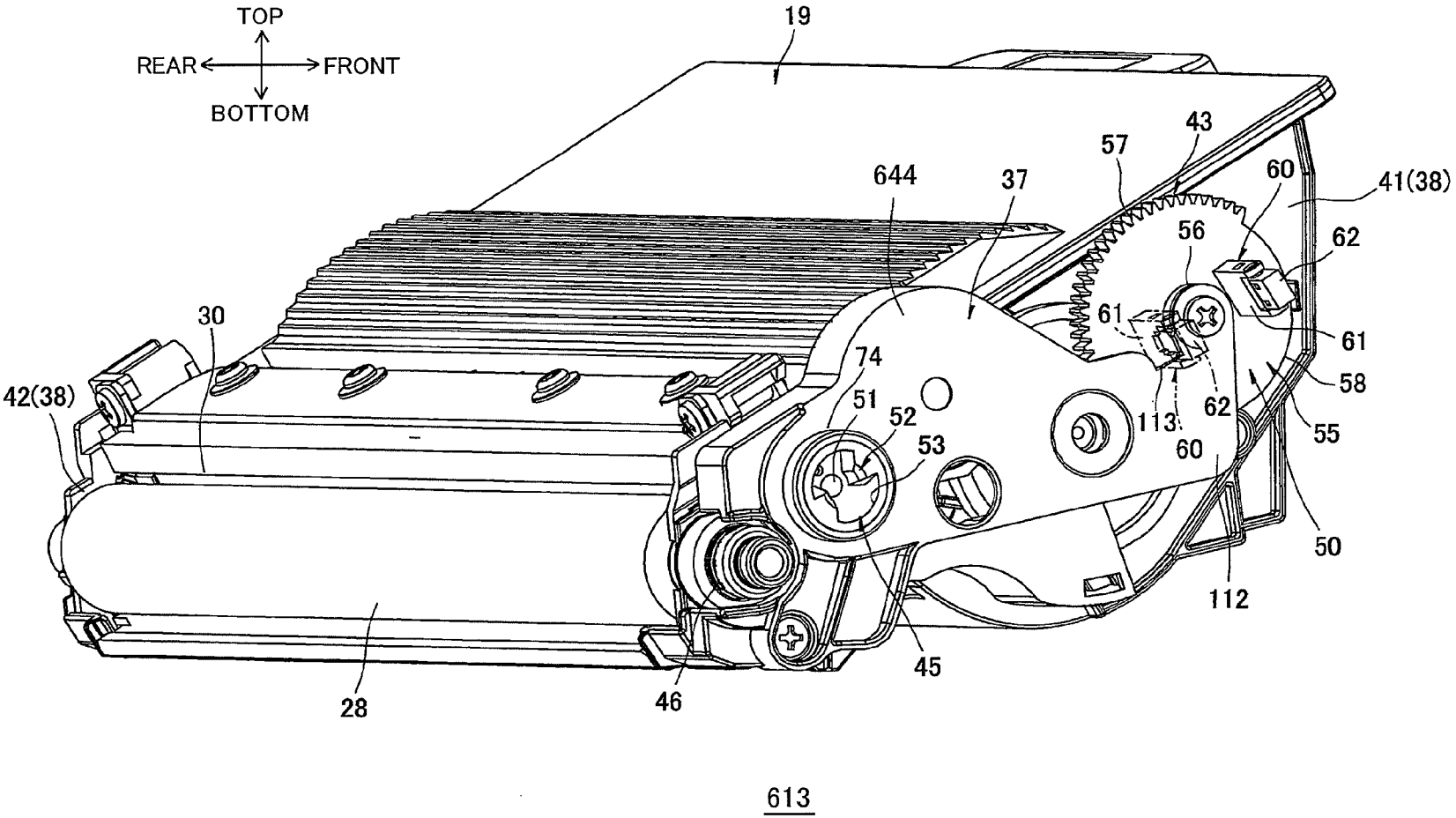
FIG. 11 is a perspective view of a developing cartridge according to a sixth embodiment of the present invention.

FIG. 11 shows a developer cartridge 613 according to a sixth embodiment, wherein like parts and components have been designated with the same reference numerals used in the first embodiment to avoid duplicating description.

In the sixth embodiment shown in FIG. 11, a gear cover 644 is provided with an extended part 112. The extended part 112 has a generally flat plate shape and is generally rectangular in a side view. The extended part 112 is formed as an extension that extends forward from a front edge of the gear cover 644.

A support part 113 is formed in a portion of the extended part 112 corresponding to the detecting-target protrusion 60 of the reset gear 50 when the reset gear 50 is in its final position and serves to support the detecting-target protrusion 60. The support part 113 is generally rectangular in a side view and is formed as a downward recess in an upper edge of the extended part 112.

The extended part 112 has an upper front corner that is fixed to the rotational shaft 54 with a screw.

Hence, in the sixth embodiment, if the developing cartridge 613 is used and, hence, the reset gear 50 is in the final position, the detecting-target protrusion 60 of the reset gear 50 is accommodated in the support part 113. As a result, the reset gear 50 (detecting-target protrusion 60) can be reliably maintained in the final position, even when subjected to vibrations during image-forming operations on the printer 1 and the like.

Further, when performing an operation to remove a used developing cartridge 613 from the main casing 2, the developing cartridge 613 can be smoothly removed from the main casing 2 even when the pivoting part 62 contacts the member 110 in the main casing 2 (or the main casing 2 itself) because the pivoting part 62 can pivot rearward from the erect position into the collapsed position. A used developing cartridge 613 can similarly be mounted smoothly into the main casing 2.

(3) Seventh Embodiment

Figure 12:
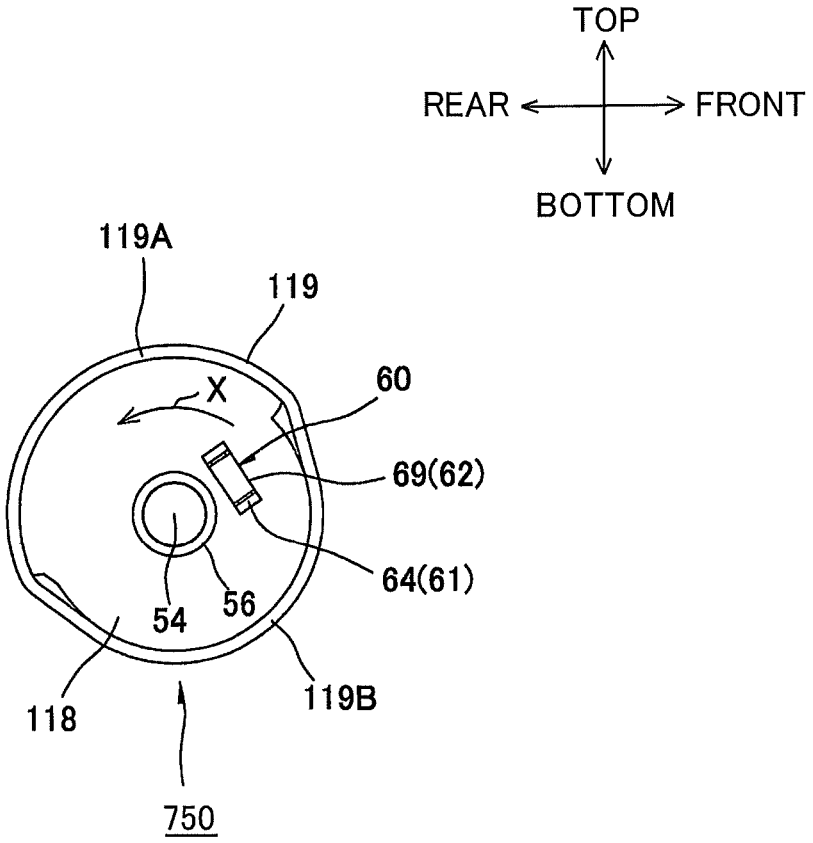
FIG. 12 is a left side view of a reset gear according to a seventh embodiment of the present invention.

FIG. 12 shows a reset gear 750 according to a seventh embodiment, wherein like parts and components are designated with the same reference numerals used in the first embodiment to avoid duplicating description.

In the first embodiment shown in FIG. 2, the reset gear 50 includes the sector gear part 55 having the toothed portion 57 formed on a portion of the outer peripheral surface of the sector gear part 55. However, the reset gear 750 according to the seventh embodiment shown in FIG. 12 includes a fan-like main body 118 in place of the sector gear part 55. Specifically, the main body 118 is plate-shaped and centered on the rotational shaft 54. The main body 118 integrally includes a large-diameter portion 119A and a small-diameter portion 119B, a boundary of which is formed in a stepped manner. An endless resistance-applying member 119 is fitted over an entire outer peripheral surface of the main body 118. The resistance-applying member 119 is formed of a rubber or other material having a relatively high friction coefficient. The detecting-target protrusion 60 is disposed on the small-diameter portion 119B.

In this case, the gear teeth 47 may be or may not be formed on the peripheral surface of the agitator gear (not shown). The large-diameter portion 119A is capable of contacting the gear teeth 47 of the agitator gear (or the agitator gear itself when the gear teeth 47 is not provided) with its outer peripheral surface, while the small-diameter portion 119B does not contact the gear teeth 47 of the agitator gear (or the agitator gear itself).

With this construction, the drive force inputted into the input gear 45 can be transmitted through the gear train (not shown) to the reset gear 750 for rotating the reset gear 750 in the rotating direction X (counterclockwise in a left side view).

Hence, in the seventh embodiment, the same operational advantages as the first embodiment can be obtained.

It should be noted that the constructions described above with respect to the first through seventh embodiments can be combined selectively and appropriately.

While the invention has been described in detail with reference to the embodiments thereof, it would be apparent to those skilled in the art that various changes and modifications may be made therein without departing from the spirit of the invention.

What is claimed is:

1. A cartridge comprising:

a developer accommodating casing;

a rotatable body rotatably provided at the casing and configured to rotate about a rotational axis upon receipt of a driving force, the rotatable body having an outer circumference defining a rotational path during rotation;

a pivot member disposed at the rotatable body at a position offset from the rotational axis and configured to pivot about a pivot fulcrum extending in a direction parallel to a tangential direction of the rotational path, the pivot member being pivotably movable between an erect position in which the pivot member erects to form a first angle relative to the rotatable body and a collapsed position in which the pivot member pivots toward the rotatable body to form a second angle smaller than the first angle relative to the rotational body; and a biasing member configured to bias the pivot member toward the erect position.

2. The cartridge according to claim 1, wherein the rotatable body comprises a gear member.

3. The cartridge according to claim 1, wherein the pivot fulcrum comprises a pivot shaft defining a radial direction, and wherein the pivot member extends outwardly in the radial direction of the pivot shaft.

4. The cartridge according to claim 1, wherein the pivot member has a distal end opposite to the pivot fulcrum and a spherical portion disposed at the distal end.

5. The cartridge according to claim 1, wherein the biasing member is a coil spring.

6. The cartridge according to claim 1, wherein the biasing member is an elastic member made of a rubber-like material.

7. The cartridge according to claim 1, wherein the rotatable body comprises:

a main body portion defining an outer peripheral surface; and a resistance-applying member made of a rubber-like material, the resistance-applying member being provided around the outer peripheral surface of the main body portion.

* * * * *